US009612543B2

(12) United States Patent
Joo et al.

(10) Patent No.: US 9,612,543 B2
(45) Date of Patent: Apr. 4, 2017

(54) TONER FOR DEVELOPING ELECTROSTATIC LATENT IMAGES

(71) Applicant: SAMSUNG ELECTRONICS CO., LTD., Suwon-si, Gyeonggi-do (KR)

(72) Inventors: Hae-ree Joo, Seoul (KR); Yo-da Shin, Suwon-si (KR); Seung-jun Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 20 days.

(21) Appl. No.: 14/495,003

(22) Filed: Sep. 24, 2014

(65) Prior Publication Data

US 2015/0192870 A1 Jul. 9, 2015

(30) Foreign Application Priority Data

Jan. 8, 2014 (KR) ..... 10-2014-0002502

(51) Int. Cl.
*G03G 9/087* (2006.01)
*G03G 9/093* (2006.01)

(52) U.S. Cl.
CPC ..... *G03G 9/08782* (2013.01); *G03G 9/09342* (2013.01); *G03G 9/09357* (2013.01); *G03G 9/09371* (2013.01); *G03G 9/09378* (2013.01); *G03G 9/09392* (2013.01)

(58) Field of Classification Search
CPC ..... G03G 9/093; G03G 9/0935
See application file for complete search history.

(56) References Cited

U.S. PATENT DOCUMENTS

| | | | | |
|---|---|---|---|---|
| 2004/0146309 | A1 | 7/2004 | Shu et al. | |
| 2009/0087768 | A1* | 4/2009 | Tosaka | G03G 9/0806 430/108.8 |
| 2010/0067956 | A1* | 3/2010 | Cheong | G03G 9/0819 399/254 |
| 2012/0196218 | A1* | 8/2012 | Hong | G03G 9/0804 430/105 |

* cited by examiner

*Primary Examiner* — Peter Vajda
(74) *Attorney, Agent, or Firm* — Staas & Halsey LLP

(57) ABSTRACT

Toner for developing electrostatic images including core particles that contain a colorant, a binder resin, and a wax, and exhibiting low-temperature fixability, high-temperature anti-offset property, image durability, flowability, high-temperature preservability, and low particle emission rate.

18 Claims, No Drawings

TONER FOR DEVELOPING ELECTROSTATIC LATENT IMAGES

CROSS-REFERENCE TO RELATED APPLICATIONS

This application claims the benefit of Korean Patent Application No. 10-2014-0002502, filed on Jan. 8, 2014, in the Korean Intellectual Property Office, the disclosure of which is incorporated herein in its entirety by reference.

BACKGROUND

1. Field

One or more embodiments of the present invention relate to toners for electrophotography, and more particularly, to toners for developing electrostatic latent images.

2. Description of the Related Art

Volatile organic compounds and particulate matter are typically generated in an electrophotographic printing process of a laser printer. It has been reported that particulate matter, such as fine particles (FP) and ultra-fine particles (UFP), is harmful to the human body. Accordingly, there is a need to limit the amount of the particulate matter generated in the printing process of a laser printer. For example, in 2012, the particle emission rate (PER) was newly introduced into Germany's Blue Angel Certification.

The reason for the generation of the particulate matter in the electrophotographic printing process is that heat and pressure are applied to a toner in a toner fusing step. The particulate matter, such as FP and UFP, may be generated from a toner and a fuser roller during the application of heat and pressure to the toner. Stress (heat and pressure) applied to the toner is being further increased according to the demand for high-resolution printing and high-speed printing. Accordingly, the amount of the particulate matter generated from the toner will be further increased.

In order to remove the particulate matter which is generated from the toner, it may be considered that a filter unit is additionally installed at the inside or the outside of the printer. However, the addition of the filter unit may further complicate the structure of the printer. Accordingly, it further makes the maintenance of the printer cumbersome and increases the price of the printer. Eventually, it may seriously reduce a consumer's purchase motivation. Therefore, it is expected that an approach in terms of toner itself may be more efficient in reducing the amount of the particulate matter.

It is preferable that the toner have an excellent fixing property in order to secure reliability of the electrophotographic printing process itself. In particular, for high-speed printing, it is preferable that the toner have a wide fixing (temperature) range. In order for the toner to have a wide fixing temperature range, it is preferable that the toner be effectively fixed even at a lower temperature. This may be expressed as a minimum fusing temperature (MFT). In addition, in order for toner to have a wide fixing range, it is preferable that the toner exhibit an excellent anti-offset property even at a higher temperature. The term "offset" denotes that at least a portion of toner constituting a toner image which is developed from an electrostatic latent image is not transferred to a medium such as paper.

Simultaneously satisfying the low-temperature fixing property and the high-temperature anti-offset property is a very difficult technical challenge. Numerous efforts have been made to address this technical challenge. A toner typically includes a colorant, a binder resin, and a releasing agent. For example, it is known that the low-temperature fixing property and the high-temperature anti-offset property may be simultaneously satisfied by using, as the binder resin of the toner, a mixture of a low molecular weight resin having a critical molecular weight or less and a high molecular weight resin having a very large molecular weight. With respect to this approach, the low molecular weight resin and the high molecular weight resin each independently control the low-temperature fixing property and the high-temperature anti-offset property, respectively. In the low molecular weight resin having a critical molecular weight or less, less entanglement between its molecular chains may occur. Accordingly, the low molecular weight resin having a critical molecular weight or less may reduce the MFT of the toner. In contrast, in the high molecular weight resin having a very large molecular weight, a lot of entanglement between its molecular chains may occur. Thus, the high molecular weight resin having a large molecular weight may allow the toner to maintain its elasticity even at a high temperature. That is, the high molecular weight resin having a very large molecular weight may improve the high-temperature anti-offset property of toner. The releasing agent (e.g., wax) may function to allow toner to be easily exfoliated from a developing roller. Accordingly, the releasing agent may also improve the anti-offset property of toner. It is known that it is preferable that the releasing agent (e.g., wax) has appropriate compatibility or miscibility with a binder resin. When the compatibility or miscibility of the releasing agent and the binder resin is excessively high, the amount of wax grains protruding from the surface of the toner may increase to cause the contamination of components, such as a developing roller, a photoreceptor, and a carrier. Also, in order for toner to be fully functional, it is preferable that the toner have image durability, flowability, and high-temperature preservability in addition to the low-temperature fixability and the high-temperature anti-offset property.

Thus, with respect to the conventional toner, the selection of appropriate physical properties of a binder resin and a releasing agent is focused on enabling the coexistence of low-temperature fixability, high-temperature anti-offset property, image durability, flowability, and high-temperature preservability.

SUMMARY

It has been found that the conventional toner, which focuses on the coexistence of low-temperature fixability, high-temperature anti-offset property, image durability, flowability, and high-temperature preservability, may not satisfy low PER (particle emission rate) requirements.

In an attempt to satisfy the low PER requirements, the use of a binder resin and a releasing agent which have a low weight loss value measured by thermogravimetric analysis (TGA) has been considered. It has been found that the low PER requirements alone may be satisfied when the binder resin and releasing agent having a low TGA weight loss value are used. However, it has also been found that a toner, which entirely satisfies low-temperature fixability, high-temperature anti-offset property, image durability, flowability, and high-temperature preservability as well as the low PER requirements, is very difficult to obtain by just using a binder resin and a releasing agent which have a low TGA weight loss value.

Thus, the present disclosure provides a toner for developing electrostatic latent images which entirely satisfies low-temperature fixability, high-temperature anti-offset property, image durability, flowability, and high-temperature preservability as well as low PER requirements.

An embodiment of a toner according to an aspect of the present disclosure includes core particles that contain a colorant, a binder resin, and a wax, wherein two or more heat-absorption peaks due to melting of the wax are observed in a second scan of differential scanning calorimetry measurements on the toner, a main heat-absorption peak of the two or more heat-absorption peaks is present in a range of about 80° C. to about 100° C., a sub heat-absorption peak of the two or more heat-absorption peaks is present in a range of about 60° C. to about 80° C., a total area of the two or more heat-absorption peaks is in a range of about 1 J/g to about 10 J/g, and $P_{2848}/P_{1493}$, a ratio of $P_{2848}$ and $P_{1493}$ which are respectively peak intensities at 2848 $cm^{-1}$ and 1493 $cm^{-1}$ in a diffuse reflectance Fourier transform infrared (FT-IR) spectrum of the toner, is in a range of about 0.45 to about 0.65.

Additional aspects will be set forth in part in the description which follows and, in part, will be apparent from the description, or may be learned by practice of the presented embodiments.

DETAILED DESCRIPTION

Reference will now be made in detail to embodiments which may have different forms and should not be construed as being limited to the descriptions set forth herein. Accordingly, the embodiments are merely described below to explain aspects of the present description.

Hereinafter, a toner according to one aspect of the present disclosure will be described in more detail. An embodiment of a toner according to an aspect of the present disclosure includes core particles that contain a colorant, a binder resin, and a wax, wherein two or more heat-absorption peaks due to melting of the wax are observed in a second scan of differential scanning calorimetry measurements on the toner, a main heat-absorption peak of the two or more heat-absorption peaks is present in a range of about 80° C. to about 100° C., a sub heat-absorption peak of the two or more heat-absorption peaks is present in a range of about 60° C. to about 80° C., a total area of the two or more heat-absorption peaks is in a range of about 1 J/g to about 10 J/g, and $P_{2848}/P_{1493}$, a ratio of $P_{2848}$ and $P_{1493}$ which are respectively peak intensities at 2848 $cm^{-1}$ and 1493 $cm^{-1}$ in a diffuse reflectance Fourier transform infrared (FT-IR) spectrum of the toner, is in a range of about 0.45 to about 0.65.

Differential scanning calorimetry measurements on the toner, for example, may be performed over a temperature range of about 30° C. to about 130° C. Heat-absorption peaks observed in the above temperature range are due to the melting of the wax. The heat-absorption peaks due to the melting of the wax are measured from a heat-absorption chart which is obtained from the second scan of differential scanning calorimetry measurements on the toner.

Two or more heat-absorption peaks may be obtained by using two or more kinds of wax. As a non-limiting example, the wax may be a mixture of a paraffin-based wax and an ester-based wax. As a non-limiting example, the amount of the ester-based wax in the mixture of the paraffin-based wax and the ester-based wax may be in a range of about 10 wt % to about 50 wt % based on the total weight (100 wt %) of the mixture of the paraffin-based wax and the ester-based wax.

The main heat-absorption peak denotes a peak in a region of heat absorption curve occupying the largest area. The main heat-absorption peak is located in a range of about 80° C. to about 100° C. In a case where the main heat-absorption peak is located outside the range of about 80° C. to about 100° C., the toner may not simultaneously satisfy all of low PER (particle emission rate) requirements, low-temperature fixability, high-temperature anti-offset property, image durability, flowability, and high-temperature preservability. In particular, when the position of the main heat-absorption peak is less than about 80° C., the toner may be very difficult to satisfy the low PER requirements. For example, the main heat-absorption peak may be located in a range of about 85° C. to about 95° C.

The sub heat-absorption peak denotes a peak in a region of heat absorption curve occupying the second largest area. The sub heat-absorption peak is located in a range of about 60° C. to about 80° C. In a case where the sub heat-absorption peak is located outside the range of about 60° C. to about 80° C., the toner may not simultaneously satisfy all of low PER requirements, low-temperature fixability, high-temperature anti-offset property, image durability, flowability, and high-temperature preservability. For example, the sub heat-absorption peak may be located in a range of about 65° C. to about 75° C.

The total area of the two or more heat-absorption peaks denotes a calorimetric integral value of the two or more heat-absorption peaks. The total area of the two or more heat-absorption peaks is in a range of about 1 J/g to about 10 J/g. In a case where the total area of the two or more heat-absorption peaks is outside the range of about 1 J/g to about 10 J/g, the toner may not simultaneously satisfy all of low PER requirements, low-temperature fixability, high-temperature anti-offset property, image durability, flowability, and high-temperature preservability. In particular, when the total area of the two or more heat-absorption peaks is greater than about 10 J/g, the toner may be very difficult to satisfy image durability, flowability, and low PER requirements. In particular, when the total area of the two or more heat-absorption peaks is less than about 1 J/g, the toner may be very difficult to satisfy low-temperature fixability and high-temperature anti-offset property. For example, the total area of the two or more heat-absorption peaks may be in a range of about 1 J/g to about 9 J/g. For example, the total area of the two or more heat-absorption peaks may be in a range of about 2 J/g to about 9 J/g.

The number of the heat-absorption peaks, the position of the main heat-absorption peak, the position of the sub heat-absorption peak, and the total area of the heat-absorption peaks may be controlled by appropriately selecting the kind, number, and amount of wax components.

$P_{2848}$ and $P_{1493}$ are respectively peak intensities at 2848 $cm^{-1}$ and 1493 $cm^{-1}$ in a diffuse reflectance FT-IR spectrum of the toner. In the diffuse reflectance FT-IR spectrum of the toner, $P_{2848}$ may be detected only from the wax and $P_{1493}$ may be detected only from the binder resin. Accordingly, $P_{2848}$ represents the amount of the wax in a surface portion of a toner particle and $P_{1493}$ represents the amount of the binder resin in the surface portion of the toner particle. Thus, $P_{2848}/P_{1493}$ represents a ratio of the amount of the wax to the amount of the binder resin in the surface portion of the toner particle. In this regard, it is noted that $P_{2848}$ and $P_{1493}$, and thus, $P_{2848}/P_{1493}$ represent a composition of the "surface portion" of the toner particle. It is noted that an overall composition of the toner particle and the composition of the surface portion of the toner particle are different from each other.

$P_{2848}/P_{1493}$, the ratio of $P_{2848}$ and $P_{1493}$ which are respectively peak intensities at 2848 $cm^{-1}$ and 1493 $cm^{-1}$ in a diffuse reflectance FT-IR spectrum of the toner, is in a range of about 0.45 to about 0.65. In a case where the ratio $P_{2848}/P_{1493}$ is outside the range of about 0.45 to about 0.65, the toner may not simultaneously satisfy all of low PER requirements, low-temperature fixability, high-temperature anti-offset property, image durability, flowability, and high-temperature preservability. In particular, when the ratio $P_{2848}/P_{1493}$ is greater than about 0.65, the toner may be very difficult to satisfy low PER requirements, image durability, flowability, and high-temperature preservability. In particular, when the ratio $P_{2848}/P_{1493}$ is less than about 0.45, the toner may be very difficult to satisfy high-temperature anti-offset property. The ratio $P_{2848}/P_{1493}$ may be controlled by appropriately selecting the kinds, amounts and compatibilities of binder resin components and wax components.

According to another embodiment of the present invention, the binder resin may include two kinds of binder resins having different weight-average molecular weights. Accordingly, the toner, for example, may have a main peak in a low molecular weight range of about 10,000 g/mol to about 30,000 g/mol and a shoulder in a high molecular weight range of about 100,000 g/mol to about 5,000,000 g/mol in a molecular weight distribution curve obtained by tetrahydrofuran (THF)-soluble gel permeation chromatography (GPC). As another example, the toner may have the following molecular weight distribution: an amount of molecules having a molecular weight greater than about 5,000,000 g/mol is in a range of about 0.1 wt % to about 1 wt % based on a total weight of a THF soluble fraction of the toner; an amount of molecules having a molecular weight in a range of about 1,000,000 g/mol to about 5,000,000 g/mol is in a range of about 0.5 wt % to about 3 wt % based on the total weight of the THF soluble fraction of the toner; an amount of molecules having a molecular weight in a range of about 100,000 g/mol to about 500,000 g/mol is in a range of about 3 wt % to about 10 wt % based on the total weight of the THF soluble fraction of the toner; and an amount of molecules having a molecular weight of about 20,000 g/mol or less is in a range of about 45 wt % to about 70 wt % based on the total weight of the THF soluble fraction of the toner.

According to another embodiment of the present invention, in molecular weight measurement by using a GPC method on a THF soluble fraction, the toner may have a weight-average molecular weight of about 30,000 g/mol to about 500,000 g/mol and a Z-average molecular weight of about 1,000,000 g/mol to about 50,000,000 g/mol.

According to another embodiment of the present invention, a weight loss ratio of the wax measured by thermogravimetric analysis (TGA) at 220° C. for 1 hour may be in a range of about 0.5% to about 30%. The weight loss ratio is defined as [weight loss amount/weight before measurement]×100%.

According to another embodiment of the present invention, the toner may include the wax in an amount of about 1 wt % to about 8 wt % based on a total weight (100 wt %) of the toner.

According to another embodiment of the present invention, a weight loss ratio of the toner measured by TGA at 220° C. for 1 hour may be in a range of about 0.5% to about 3%.

According to another embodiment of the present invention, a temperature (Ts) at which a shear storage modulus (G') of the toner begins to decrease in a shear storage modulus curve of the toner according to temperature changes may be in a range of about 54° C. to about 67° C.

According to another embodiment of the present invention, the toner may further include an external additive. In this case, the toner, for example, may include about 1,000 ppm to about 10,000 ppm of iron (Fe) and about 1,000 ppm to about 5,000 ppm of silicon (Si) based on the total weight of the toner.

According to another embodiment of the present invention, the toner may further include a shell layer including a binder resin, wherein the core particle is coated with the shell layer. In this case, the toner, for example, may be prepared by a method which includes preparing a mixture by mixing a first binder resin latex, a colorant dispersion, and a releasing agent dispersion, wherein the first binder resin includes two kinds of binder resins having different weight-average molecular weights; forming core particles including the first binder resin, the colorant, and the releasing agent by adding a coagulant to the mixture; and forming a shell layer including a second binder resin on surfaces of the core particles by adding a second binder resin latex to a dispersion of the core particles to form a toner particle including the core particle and the shell layer.

Hereinafter, specific examples of materials which may be used in the toner according to embodiments of the present invention will be described.

Non-limiting examples of the binder resin for a core may be a styrene resin, an acrylic resin, a vinyl resin, a polyether polyol resin, a phenol resin, a silicon resin, a polyester resin, an epoxy resin, a polyamide resin, a polyurethane resin, a polybutadiene resin, or a mixture thereof.

Non-limiting examples of the styrene resin may be polystyrene; a homopolymer of styrene substituents such as poly-p-chlorostyrene or polyvinyltoluene; a styrene-based copolymer such as a styrene-p-chlorostyrene copolymer, a styrene-vinyltoluene copolymer, a styrene-vinylnaphthalene copolymer, a styrene-acrylic acid ester copolymer, a styrene-methacrylic acid ester copolymer, a styrene-α-chloromethacrylic acid methyl copolymer, a styrene-acrylonitrile copolymer, a styrene-vinylmethylether copolymer, a styrene-vinylethylether copolymer, a styrene-vinylmethylketone copolymer, a styrene-butadiene copolymer, a styrene-isoprene copolymer, or a styrene-acrylonitrile-indene copolymer; or a mixture thereof.

Non-limiting examples of the acrylic resin may be an acrylic acid polymer, a methacrylic acid polymer, a methacrylic acid methylester polymer, an α-chloromethacrylic acid methylester polymer, or a mixture thereof.

Non-limiting examples of the vinyl resin may be a vinyl chloride polymer, an ethylene polymer, a propylene polymer, an acrylonitrile polymer, a vinyl acetate polymer, or a mixture thereof.

As a non-limiting example, a number-average molecular weight of the binder resin for a core may be in a range of about 700 to about 1,000,000, or about 10,000 to about 200,000.

Non-limiting examples of the colorant may be a black colorant, a yellow colorant, a magenta colorant, a cyan colorant, or a combination thereof.

Non-limiting examples of the black colorant may be carbon black, aniline black, or a mixture thereof.

Non-limiting examples of the yellow colorant may be a condensed nitrogen compound, an isoindolinone compound, an antraquine compound, an azo metal complex, an allyl imide compound, or a mixture thereof. Specific non-limiting examples of the yellow colorant may be "C.I. Pigment Yellow" 12, 13, 14, 17, 62, 74, 83, 93, 94, 95, 109, 110, 111, 128, 129, 147, 168, or 180.

Non-limiting examples of the magenta colorant may be a condensed nitrogen compound, an antraquine compound, a quinacridone compound, a base dye late compound, a naphthol compound, a benzo imidazole compound, a thioindigo compound, and a perylene compound, or a mixture thereof. Specific non-limiting examples of the magenta colorant may be "C.I. Pigment Red" 2, 3, 5, 6, 7, 23, 48:2, 48:3, 48:4, 57:1, 81:1, 122, 144, 146, 166, 169, 177, 184, 185, 202, 206, 220, 221, or 254.

Non-limiting examples of the cyan colorant may be a copper phthalocyanine compound and a derivative thereof, an antraquine compound, a base dye late compound, or a mixture thereof. Specific non-limiting examples of the cyan colorant may be "C.I. Pigment Blue" 1, 7, 15, 15:1, 15:2, 15:3, 15:4, 60, 62, or 66.

As a non-limiting example, the amount of the colorant in the core particles may be in a range of about 0.1 parts by weight to about 20 parts by weight, or about 2 parts by weight to about 10 parts by weight based on 100 parts by weight of the binder resin.

Non-limiting examples of the wax may be a polyethylene-based wax, a polypropylene-based wax, a silicon-based wax, a paraffin-based wax, an ester-based wax, a carnauba-based wax, a metallocene-based wax, or a mixture thereof.

As a non-limiting example, the wax may have a melting point in a range of about 50° C. to about 150° C.

As a non-limiting example, the amount of the wax in the core particle may be in a range of about 1 part by weight to about 20 parts by weight or about 1 part by weight to about 10 parts by weight based on 100 parts by weight of the binder resin.

The shell layer surrounds the core particles. The shell layer includes a binder resin for the shell layer. Non-limiting examples of the binder resin for the shell layer may be a styrene resin, an acryl resin, a vinyl resin, a polyether polyol resin, a phenol resin, a silicon resin, a polyester resin, an epoxy resin, a polyamide resin, a polyurethane resin, a polybutadiene resin, or a mixture thereof.

Non-limiting examples of the styrene resin may be polystyrene; a homopolymer of styrene substituents such as poly-p-chlorostyrene or polyvinyltoluene; a styrene-based copolymer such as a styrene-p-chlorostyrene copolymer, a styrene-vinyltoluene copolymer, a styrene-vinylnaphthalene copolymer, a styrene-acrylic acid ester copolymer, a styrene-methacrylic acid ester copolymer, a styrene-α-chloromethacrylic acid methyl copolymer, a styrene-acrylonitrile copolymer, a styrene-vinylmethylether copolymer, a styrene-vinylethylether copolymer, a styrene-vinylmethylketone copolymer, a styrene-butadiene copolymer, a styrene-isoprene copolymer, or a styrene-acrylonitrile-indene copolymer; or a mixture thereof.

Non-limiting examples of the acrylic resin may be an acrylic acid polymer, a methacrylic acid polymer, a methacrylic acid methylester polymer, an α-chloromethacrylic acid methylester polymer, or a mixture thereof.

Non-limiting examples of the vinyl resin may be a vinyl chloride polymer, an ethylene polymer, a propylene polymer, an acrylonitrile polymer, a vinyl acetate polymer, or a mixture thereof. As a non-limiting example, a number-average molecular weight of the binder resin for the shell layer may be in a range of about 700 to about 1,000,000, or about 10,000 to about 200,000.

The binder resin for the shell layer and the binder resin for the core may be the same or different from each other.

The external additive includes silica particles and titanium-containing particles.

The silica particles, for example, may be fumed silica, sol-gel silica, or a mixture thereof.

When a primary particle size of the silica particles is excessively large, the externally added toner particles may be relatively difficult to pass through a developing blade. Accordingly, a selection phenomenon of the toner may occur. That is, as an operation time of a toner cartridge increases, a particle size of the toner particles remaining in the toner cartridge gradually increases. As a result, a charge quantity of the toner decreases, and thus a thickness of a toner layer for developing an electrostatic latent image increases. Also, when the primary particle size of the silica particles is excessively large, a probability of the silica particles being separated from the core particles, for example, due to stress which is applied to the toner particles by a member, such as a feed roller, may relatively increase. The silica particles thus separated may contaminate a charging member or a latent image carrier.

In contrast, when the primary particle size of the silica particles is excessively small, the silica particles are likely to be embedded into the core particles due to shearing stress of the developing blade which is applied to the toner particles. When the silica particles are embedded into the core particles, the silica particles may lose a function as an external additive, and thus adhesion between the toner particles and a surface of a photoreceptor may be undesirably increased. Consequently, cleaning ability and transferability of the toner may decrease.

For example, a volume-average particle size of the silica particles may be in a range of about 10 nm to about 80 nm, about 30 nm to about 80 nm, or about 60 nm to about 80 nm.

As another example, the silica particles may include silica particles with a large diameter having a volume-average particle size in a range of about 30 nm to about 100 nm and silica particles with a small diameter having a volume-average particle size in a range of about 5 nm to about 20 nm.

Since the silica particles with a small diameter may provide a larger surface area than the silica particles with a large diameter, the silica particles with a small diameter may further improve charge stability of the toner particles. Also, since the silica particles with a small diameter may be attached to core particles in the state of being disposed between the silica particles with a large diameter, shear stress may not be transferred to the silica particles with a small diameter even in the case in which the shear stress is applied to the toner particles from the outside. That is, the shear stress applied to the toner particles from the outside may be focused on the silica particles with a large diameter. Accordingly, the silica particles with a small diameter may not be embedded into the core particles, and thus an effect of improving charge stability may be maintained.

When an amount of the silica particles with a small diameter is excessively lower than that of the silica particles with a large diameter, durability of the toner may decrease and the effect of improving charge stability may be insignificant. When the amount of the silica particles with a small diameter is excessively high, contamination may occur due to poor cleaning of the charging member or latent image carrier.

A weight ratio of the silica particles with a large diameter to the silica particles with a small diameter, for example, may be in a range of about 0.5:1.5 to about 1.5:0.5.

As another example, the silica particles may include sol-gel silica having a number-average aspect ratio of about 0.83 to about 0.97. Herein, the expression "aspect ratio" denotes a ratio of a minimum diameter to a maximum diameter of a sol-gel silica particle. According to an embodiment of the present invention, a number-average aspect ratio of the sol-gel silica particles may be measured and defined in such a manner that first, a plane image magnified by 50,000 times is obtained by analyzing toner particles having the sol-gel silica particles externally added thereto with a scanning electron microscopy (SEM), an aspect ratio of each sol-gel silica particle is obtained by measuring a minimum diameter and a maximum diameter of each sol-gel silica particle shown in the plane image with an image analyzer, and the number-average aspect ratio of the sol-gel silica particles may then be defined as a value obtained by dividing a sum of the aspect ratios of the sol-gel silica particles by the number of the sol-gel silica particles. In this case, the number of the sol-gel silica particles included in the calculation of the number-average aspect ratio is fixed to be about 50.

According to an embodiment of the present invention, cleaning ability of the toner may be more significantly increased when sol-gel silica particles having a number-average aspect ratio of about 0.83 to about 0.97 are used as an external additive. An improvement of the cleaning ability of the toner denotes that the adhesion between the toner particles and the surface of the photoreceptor is appropriately reduced. When the cleaning ability of the toner is improved, the untransferred toner remaining on the photoreceptor after a transfer step may be almost completely removed by a cleaning blade in an electrophotographic process. Accordingly, contamination of a charging roller due to the untransferred toner may be suppressed. Also, a filming phenomenon on the surface of the photoreceptor due to the untransferred toner may be suppressed.

Furthermore, with respect to the remaining external additive on the photoreceptor, since the external additive is nano-sized, it may be easy for the external additive to pass through a gap between the blade and the photoreceptor. In particular, it is known that, when the external additive is more spherical, the rolling of the external additive may be more facilitated, thus the external additive may more easily pass the blade. The external additive passing the blade may contaminate the charging roller. Therefore, when the aspect ratio of the silica is reduced to prevent easy passage of the external additive, cleaning ability of the external additive may also be improved.

For example, the sol-gel silica particles may be obtained by removing a solvent from a silica sol suspension which is obtained by hydrolysis and condensation of alkoxy silane in an organic solvent including water.

A typical example of the titanium-containing particles may be titanium dioxide. However, an embodiment of the present invention is not limited thereto. Anatase titanium dioxide having an anatase crystal structure and rutile titanium dioxide having a rutile crystal structure may be used as the titanium dioxide. The reason for using the titanium dioxide as the external additive of the toner is that, when only silica having strong negative chargeability is externally added, charge-up of the surface of the toner may easily occur and an amount of the toner attached to a developing roller may increase, in particular, in a contact development system, thus increasing the thickness of the toner layer. In a case where titanium oxide is not used in a non-contact development system, the charge quantity may be high to reduce developing ability, and thus an image concentration may be low. Therefore, in order to stabilize rapid changes in charge when only silica is externally added, titanium oxide is added to reduce charge deviation in a high-temperature and high-humidity environment or a low-temperature and low-humidity environment and ameliorate charge-up. However, when titanium oxide is excessively used, background contamination may occur. Thus, an appropriate ratio of silica having strong negative chargeability and titanium oxide having low negative chargeability may affect an electrophotographic system, such as durability and other image contaminations, as well as the charge quantity.

The silica particles and the titanium dioxide particles, for example, may be hydrophobically treated with silicone oils, silanes, siloxanes, or silazanes. A degree of hydrophobicity of each of the silica particles and the titanium dioxide particles may be in a range of about 10 to about 90. The degree of hydrophobicity denotes a value measured using a methanol titration method known in the art. For example, the degree of hydrophobicity may be measured as follows: 0.2 g of silica particles or titanium dioxide particles for which a degree of hydrophobicity is measured is added to a glass beaker having an inner diameter of 7 cm and a volume of 2 l or more to which 100 ml of deionized water is added, and is stirred with a magnetic stirrer. A tip of a burette containing methanol is immersed in the solution thus prepared, 20 ml of methanol is dripped thereto while stirring, the stirring is stopped after 30 seconds, and a state of the solution one minute after stopping the stirring is observed. This operation is repeatedly performed. If a total amount of the methanol added when the silica particles do not float on a surface of the solution one minute after stopping the stirring is taken as Y (ml), a value calculated by the following equation is obtained as the degree of hydrophobicity. A temperature of the solution in the beaker is adjusted to 20° C.±1° C. during the measurement. A degree of hydrophobicity=[Y/(100+Y)×100].

In the toner according to an embodiment of the present invention, the core particles and the shell layer may be prepared by an aggregation method using an iron-containing coagulant. Accordingly, the core particle and the shell layer may further include iron. Also, the core particle and the shell layer may contain iron in the form of an iron-containing coagulant. A typical example of the iron-containing coagulant may be polysilica iron.

EXAMPLES

Preparation Example 1

Preparation of Low-Molecular Weight Latex

A polymerizable monomer mixture (825 g of styrene and 175 g of n-butyl acrylate), 30 g of β-carboxyethylacrylate, 17 g of 1-dodecanethiol as a chain transfer agent, and 418 g of sodium dodecyl sulfate (2 wt % aqueous solution) as an emulsifier were put in a 3 L beaker and stirred to prepare a polymerizable monomer emulsion. 16 g of ammonium persulfate (APS) as an initiator and 696 g of sodium dodecyl sulfate (0.4 wt % aqueous solution) as an emulsifier were put in a 3 L double-jacketed reactor that is heated to a temperature of 75° C., and the polymerizable monomer emulsion prepared as described above was then added dropwise thereto for 2 hours while stirring to initiate a polymerization reaction. The polymerization reaction was continued at a reaction temperature of 75° C. for 8 hours. A diameter of the binder resin latex particles thus prepared was measured by a light scattering method using "Microtrac" and was in a range of 180 nm to 250 nm. A solid content of the latex measured by a loss-on-drying method was 42 wt %. A weight-average molecular weight (Mw) of the latex measured using a gel permeation chromatography (GPC) method on a tetrahydrofuran (THF) soluble fraction was 25,000 g/mol. A glass transition temperature of the latex measured using a differential scanning calorimeter (DSC, Perkin Elmer, Inc.) in a second scan at a heating rate of 10° C./min was 62° C.

Preparation Example 2

Preparation of High-Molecular Weight Latex

A polymerizable monomer mixture (685 g of styrene and 315 g of n-butyl acrylate), 30 g of β-carboxyethylacrylate, and 418 g of sodium dodecyl sulfate (2 wt % aqueous solution) as an emulsifier were put in a 3 L beaker and stirred to prepare a polymerizable monomer emulsion. 5 g of APS as an initiator and 696 g of sodium dodecyl sulfate (0.4 wt % aqueous solution) as an emulsifier were put in a 3 L double-jacketed reactor that is heated to a temperature of 60° C., and the polymerizable monomer emulsion prepared as described above was then added dropwise thereto for 3 hours while stirring to initiate a polymerization reaction. The polymerization reaction was performed at a reaction temperature of 75° C. for 8 hours. A diameter of the binder resin latex particles thus prepared was measured by a light scattering method using "Horiba 910", and was in a range of 180 nm to 250 nm. A solid content of the latex measured by a loss-on-drying method was 42 wt %. A weight-average molecular weight (Mw) of the latex measured using a GPC method on a THF soluble fraction was 250,000 g/mol. A glass transition temperature of the latex measured using a DSC (PerkinElmer, Inc.) in a second scan at a heating rate of 10° C./min was 53° C.

Preparation Example 3

Preparation of Pigment Dispersion

About 10 g of sodium dodecyl sulfate as an anionic reactive emulsifier and 60 g of carbon black were put in a milling bath and 400 g of glass beads having a diameter of 0.8 mm to 1 mm were introduced thereinto. Then, milling was performed at room temperature to prepare a dispersion. A diameter of pigment particles in the pigment dispersion was measured by a light scattering method (Horiba 910) and was in a range of 180 nm to 200 nm. A solid content of the prepared pigment dispersion was 18.5 wt %.

Preparation Example 4

Preparation of Wax Dispersion

About 300 g of deionized water, 10 g of sodium dodecyl sulfate as an anionic reactive emulsifier, and 90 g of Carnauba Wax (Japan Oil Co.) were put in a reactor and stirred at a temperature of 90° C. using a homogenizer at 14,000 rpm for 20 minutes to prepare a wax dispersion. A diameter of wax particles in the wax dispersion was measured by a light scattering method (Horiba 910), and was in a range of 250 nm to 300 nm. A solid content of the prepared wax dispersion was 30 wt %.

Example 1

Preparation of Toner

About 3,000 g of deionized water, 1,137 g of a first latex mixture for a core (a mixture of 91.5 wt % of the low-molecular weight latex of Preparation Example 1 and 8.5 wt % of the high-molecular weight latex of Preparation Example 2), 195 g of the pigment dispersion of Preparation Example 3, and 184 g of the wax dispersion of Preparation Example 4 were put in a 7 L reactor, and a mixture of 364 g of a nitric acid aqueous solution (0.3 mol) and 182 g of PSI-100 (Suido Kiko Kaisha, Ltd.) was added thereto. Then, an aggregate having a diameter of 1.5 μm to 2.5 μm was obtained by stirring at 11,000 rpm for 6 minutes using a homogenizer. The mixture thus obtained was put in a 7 L double-jacketed reactor and heated from room temperature to a temperature of 55° C. (glass transition temperature (Tg) of the latex −5° C.) at a heating rate of 0.5° C. per minute. When the diameter of the aggregate reached 6.0 μm, 442 g of a second latex mixture for a shell (a mixture of 90 wt % of the low-molecular weight latex of Preparation Example 1 and 10 wt % of the high-molecular weight latex of Preparation Example 2) was slowly added thereto for 20 minutes, and when D50 (volume) became 6.8 μm, NaOH (1 mol) was added to adjust a pH level to be 7. When a value of the particle size D50 (volume) was constantly maintained for 10 minutes, the temperature was increased to 96° C. When the temperature reached 96° C., the pH level was adjusted to 6.0. Then, a second aggregation toner in the shape of a potato having a diameter of 6.5 μm to 7.0 μm was obtained by unifying the mixture thus prepared for 3 to 5 hours. Subsequently, the aggregation reaction solution was cooled below Tg and then filtered to separate and dry toner particles.

About 2.0 parts by weight of sol-gel silica powder (about 70 nm), 0.5 parts by weight of titanium dioxide powder (about 50 nm), and 0.5 parts by weight of titanium strontium oxide ($SrTiO_3$, 100 nm) were added to 100 parts by weight of the dried toner particles and stirred by using a mixer (KM-LS2K, Dae Wha Tech Co, Ltd.) at 8,000 rpm for 4 minutes to obtain an externally added toner. A volume-average diameter of the externally added toner was in a range of 6.5 μm to 7.0 μm. GSDp and GSDv values of the externally added toner were 1.282 and 1.217, respectively. Also, an average circularity of the externally added toner was 0.971.

Example 2

Preparation of Toner

About 3,000 g of deionized water, 1,137 g of a first latex mixture for a core (a mixture of 91.5 wt % of latex-1 and 8.5 wt % of latex-2), 195 g of the pigment dispersion of Preparation Example 3, and 184 g of the wax dispersion of Preparation Example 4 were put in a 7 L reactor, and a mixture of 364 g of a nitric acid aqueous solution (0.3 mol) and 182 g of PSI-100 (Suido Kiko Kaisha, Ltd.) was added thereto. Then, an aggregate having a diameter of 1.5 μm to 2.5 μm was obtained by stirring at 11,000 rpm for 6 minutes using a homogenizer. The mixture thus obtained was put in a 7 L double-jacketed reactor and heated from room temperature to a temperature of 55° C. (glass transition temperature (Tg) of the latex −5° C.) at a heating rate of 0.5° C. per minute. When the diameter of the aggregate reached 6.0 μm, 442 g of a second latex mixture for a shell (a mixture of 90 wt % of the low-molecular weight latex of Preparation Example 1 and 10 wt % of the high-molecular weight latex of Preparation Example 2) was slowly added thereto for 20 minutes, and when D50 (volume) became 6.8 μm, NaOH (1 mol) was added to adjust a pH level to be 6.8. When a value of the particle size D50 (volume) was constantly maintained for 10 minutes, the temperature was increased to 96° C. When the temperature reached 96° C., the pH level was adjusted to 6.3. Then, a second aggregation toner in the shape of a potato having a diameter of 6.5 μm to 7.0 μm was obtained by unifying the aggregated particle thus prepared for 3 to 5 hours. Subsequently, an aggregation reaction solution was cooled below Tg and then filtered to separate and dry toner particles.

About 0.5 parts by weight of NX-90 (Nippon Aerosil), 1.0 part by weight of RX-200 (Nippon Aerosil), and 0.5 parts by weight of SW-100 (Titan Kogyo) were added to 100 parts by weight of the dried toner particles and stirred by using a mixer (KM-LS2K, Dae Wha Tech Co, Ltd.) at 8,000 rpm for 4 minutes to obtain an externally added toner. A volume-average diameter of the externally added toner was in a range of 6.5 μm to 7.0 μm. GSDp and GSDv values of the externally added toner were 1.282 and 1.217, respectively. Also, an average circularity of the externally added toner was 0.971.

Example 3

A toner was prepared in the same manner as in Example 1 except that 80 g of the wax dispersion of Preparation Example 4 was used.

Example 4

A toner was prepared in the same manner as in Example 1 except that 131 g of the wax dispersion of Preparation Example 4 was used.

Comparative Example 1

A toner was prepared in the same manner as in Example 1 except that adding of a second latex for a shell was omitted.

Comparative Example 2

A toner was prepared in the same manner as in Example 1 except that 480 g of a second latex for a shell was used.

Comparative Example 3

A toner was prepared in the same manner as in Example 1 except that 240 g of the wax dispersion of Preparation Example 4 was used.

Comparative Example 4

A toner was prepared in the same manner as in Example 1 except that 13 g of the wax dispersion of Preparation Example 4 was used.

Comparative Example 5

A toner was prepared in the same manner as in Example 1 except that HNP9 (paraffin wax, Nippon Seiro, Japan) was used as a wax dispersion.

Comparative Example 6

A toner was prepared in the same manner as in Example 1 except that WE-5 (paraffin wax, NOF Corporation, Japan) was used as a wax dispersion.

EVALUATION OF EXAMPLES

DSC Analysis

Differential scanning calorimetry (DSC) analysis was performed using a differential scanning calorimeter (PerkinElmer, Inc.). 6 mg of a toner sample was put in an aluminum pan. An empty aluminum pan was used as a reference sample. A measurement temperature range was from 20° C. to 200° C. A heating rate was 1.0° C./min. A modulation amplitude was ±0.5° C. and a frequency was 1/min. Positions of a main heat-absorption peak and a sub heat-absorption peak were identified from a heat-absorption chart obtained during a second heating. A calorimetric integral value (J/g) per 1 g of the toner, which was expressed as a total area of the heat-absorption peak, was measured from the heat-absorption chart obtained during the second heating. An area of a region, which is surrounded by a reversible heat flow curve observed from the heat-absorption chart obtained during the second heating and a straight line connecting measurement points at 35° C. and 135° C., was determined as the calorimetric integral value of the heat-absorption peaks.

Thermogravimetric Analysis (TGA)

Equipment: TGA Q500 (TA Instrument, USA)

Sample weight: 5 to 15 mg

Carrier gas: air

Heating range: room temperature to 220° C.

Hold: 60 min

Ramping rate: 20 min/° C.

A weight loss ratio (%) was measured after the sample was left standing at 220° C. for 1 hour.

Fourier transform infrared (FT-IR) Analysis

Equipment: FT-IR with Microscope ATR (NICOLET380, Nicolet, USA)

Measurement method: measured using attenuated total reflection (ATR) technique

Data processing: a ratio of heights of peaks detected at wave numbers of 2848 $cm^{-1}$ and 1493 $cm^{-1}$, which respectively corresponded to the wax and the binder alone, was calculated.

Fixability Measurement of Toner

After printing an image on 50 sheets of paper with a printer (ML-6510, Samsung Electronics, S. Korea), a fixability of the fixed image was evaluated as follows: an optical density of the fixed image was measured, and a 3M 810 tape was then attached to an image portion. A 500 g weight disposed on the tape was moved back and forth five times, and the tape was then peeled. Then, optical density after the tape peeling was measured.

$$\text{Fixability (\%)} = (\text{optical density after tape peeling} / \text{optical density before tape attachment}) \times 100$$

An average value of 3 sheets was obtained.

Minimum Fixing Temperature (MFT) Measurement

Measurement temperature range: 155° C. to 210° C.

Temperature interval: 5° C.

Paper: Xerox 90 g paper

Printer: ML-6510 (Samsung Electronics, S. Korea)

Print speed: 24 ppm

MFT is defined as the lowest temperature at which a fixing rate is 90%.

Hot Offset Temperature (HOT) Measurement

Measurement temperature range: 155° C. to 210° C.

Temperature interval: 5° C.

Paper: Xerox 90 g paper

Printer: ML-6510 (Samsung Electronics, S. Korea)

Print speed: 24 ppm

HOT is defined as the lowest temperature at which "hot offset" occurs.

Image Durability

A 1% coverage pattern was continuously printed with a printer (manufacturer: Samsung Electronics, model: Mono Laser ML6510), and it was then identified how long an image concentration of a solid pattern was maintained. Image durability was evaluated on the following criteria.

⊙: maintaining constant image concentration for printing 5,000 or more sheets

○: maintaining constant image concentration for printing 3,000 or more sheets and less than 5,000 sheets Δ: maintaining constant image concentration for printing 1,000 or more sheets and less than 3,000 sheets ×: printing constant image concentration for less than 1,000 sheets.

Toner Flowability

Equipment: Hosokawa micron powder tester PT-S

Sample size: 2 g

Amplitude: 1 mm dial 3 to 3.5

Sieve: 53, 45, 38 μm

Vibration time: 120±0.1 seconds

Samples were stored at room temperature and at a RH of 55±5% for 2 hours, changes in the weight of each sample were then measured before and after sieving each sample with different size sieves under the above conditions to calculate cohesiveness of each toner as follows:

[(mass of powder remaining on 53 μm sieve)/2 g]×100 1)

[(mass of powder remaining on 45 μm sieve)/2 g]×100×(3/5) 2)

[(mass of powder remaining on 38 μm sieve)/2 g]×100×(1/5) 3)

Cohesiveness (Carr's cohesion)=(1)+(2)+(3)

Flowability Evaluation Criteria

○: Good flowability having a cohesiveness of 15 or less

Δ: Inferior flowability having a cohesiveness of 15 to 20

×: Poor flowability having a cohesiveness greater than 20 or more

High-Temperature Preservability of Toner

About 100 g of a toner was externally added, and then put in a developer and stored in a packaged state in a constant temperature and humidity oven under the following conditions:

23° C., 55% relative humidity (RH), 2 hours

=>40° C., 90% RH, 48 hours

=>50° C., 80% RH, 48 hours

=>40° C., 90% RH, 48 hours

=>23° C., 55% RH, 6 hours.

After storing under the above conditions, the presence of caking of the toner in the developer was visually identified and image defects were evaluated by printing a 100% solid pattern.

Evaluation Criteria

○: Good image, no caking

Δ: Poor image, no caking

×: Occurrence of caking.

Particle Emission Rate (PER)

A toner sample was installed on a printer (manufacturer: Samsung Electronics, model: Mono Laser ML6510) to measure a particle emission rate in accordance with RAL-UZ171 standard for Germany's Blue Angel Certification. A volume of a chamber used was 5 $m^3$.

Measurement Results

TABLE 1

| Item | Main heat-absorption peak (° C.) | Sub heat-absorption peak (° C.) | ΔH (J/g) | Wax TGA weight loss ratio (%) | $P_{2848}/P_{1493}$ ratio | Toner TGA weight loss ratio (%) |
|---|---|---|---|---|---|---|
| Example 1 | 90 | 73 | 10 | 28 | 0.58 | 0.5 |
| Example 2 | 90 | 72 | 9 | 30 | 0.64 | 0.5 |
| Example 3 | 91 | 72 | 2 | 29 | 0.46 | 0.3 |
| Example 4 | 90 | 73 | 7 | 30 | 0.52 | 0.3 |
| Comparative Example 1 | 90 | 71 | 10 | 27 | 0.67 | 0.5 |
| Comparative Example 2 | 91 | 71 | 9 | 29 | 0.41 | 0.5 |
| Comparative Example 3 | 90 | 71 | 12 | 27 | 0.59 | 0.7 |
| Comparative Example 4 | 91 | 71 | 0.5 | 28 | 0.38 | 0.5 |
| Comparative Example 5 | 76 | — | 10 | 38 | 0.45 | 4.3 |
| Comparative Example 6 | 78 | — | 7 | 52 | 0.43 | 3.2 |

TABLE 2

| Item | MFT (° C.) | HOT (° C.) | Image durability | Flowability | High-temperature preservability | Particle emission rate (PER) |
|---|---|---|---|---|---|---|
| Example 1 | 165 | 210 | ○ | ○ | ○ | ○ |
| Example 2 | 165 | 210 | ○ | ○ | ○ | ○ |
| Example 3 | 165 | 210 | ○ | ○ | ○ | ○ |
| Example 4 | 165 | 210 | ○ | ○ | ○ | ○ |
| Comparative Example 1 | 165 | 205 | X | X | X | NG (no good) |

TABLE 2-continued

| Item | MFT (° C.) | HOT (° C.) | Image durability | Flowability | High-temperature preservability | Particle emission rate (PER) |
|---|---|---|---|---|---|---|
| Comparative Example 2 | 175 | 190 | ○ | ○ | ○ | ○ |
| Comparative Example 3 | 165 | 210 | X | X | ○ | NG |
| Comparative Example 4 | 175 | 185 | ○ | ○ | ○ | ○ |
| Comparative Example 5 | 165 | 205 | ○ | ○ | ○ | NG |
| Comparative Example 6 | 165 | 210 | ○ | ○ | ○ | NG |

In Table 2, "NG" denotes that a value of $PER_{10pw}$ (unit: particles/10 min) measured in accordance with RAL-UZ171 standard for Germany's Blue Angel Certification was greater than $3.5\times10^{11}$.

As described above, according to the one or more of the above embodiments of the present invention, in a case where a toner, which includes core particles containing a colorant, a binder resin, and a wax, meets all of the following conditions, a critical effect of simultaneously satisfying all of low-temperature fixability, high-temperature anti-offset property, image durability, flowability, and high-temperature preservability as well as low PER requirements may be achieved:

condition 1) two or more heat-absorption peaks due to melting of the wax are observed in a second scan of differential scanning calorimetry (DSC) measurements on the toner;

condition 2) a main heat-absorption peak of the two or more heat-absorption peaks is present in a range of about 80° C. to about 100° C.;

condition 3) a sub heat-absorption peak of the two or more heat-absorption peaks is present in a range of about 60° C. to about 80° C.;

condition 4) a total area of the two or more heat-absorption peaks is in a range of about 1 J/g to about 10 J/g; and condition 5) $P_{2848}/P_{1493}$, a ratio of $P_{2848}$ and $P_{1493}$ which are respectively peak intensities at 2848 $cm^{-1}$ and 1493 $cm^{-1}$ in a diffuse reflectance Fourier transform infrared (FT-IR) spectrum of the toner, is in a range of about 0.45 to about 0.65.

The expression "low PER requirements" denotes that a value of $PER_{10pw}$ (unit: particles/10 min) measured in accordance with RAL-UZ171 standard of Germany's Blue Angel Certification is $3.5\times10^{11}$ or less.

It should be understood that the exemplary embodiments described herein should be considered in a descriptive sense only and not for purposes of limitation. Descriptions of features or aspects within each embodiment should typically be considered as available for other similar features or aspects in other embodiments.

What is claimed is:

1. A toner, comprising:

core particles that contain a colorant, a binder resin, and a wax, wherein two or more heat-absorption peaks due to melting of the wax are observed in a second scan of differential scanning calorimetry measurements on the toner, a main heat-absorption peak of the two or more heat-absorption peaks is present in a range of about 80° C. to about 100° C., a sub heat-absorption peak of the two or more heat-absorption peaks is present in a range of about 60° C. to about 80° C., a total area of the two or more heat-absorption peaks is in a range of about 1 J/g to about 10 J/g, and $P_{2848}/P_{1493}$, a ratio of $P_{2848}$ and $P_{1493}$ which are respectively peak intensities at 2848 $cm^{-1}$ and 1493 $cm^{-1}$ in a diffuse reflectance Fourier transform infrared spectrum of the toner, is in a range of about 0.45 to about 0.65, wherein $P_{2848}$ represents an amount of the wax in a surface portion of the toner core particles and $P_{1493}$ represents an amount of the binder resin in the surface portion of the toner core particles, and wherein the binder resin includes at least one of a styrene-acrylic acid ester copolymer, a styrene-methacrylic acid ester copolymer or a styrene-α-chloromethacrylic acid methyl copolymer, and the wax includes a carnauba-based wax.

2. The toner of claim 1, wherein the main heat-absorption peak is located in a range of about 85° C. to about 95° C.

3. The toner of claim 1, wherein the sub heat-absorption peak is located in a range of about 65° C. to about 75° C.

4. The toner of claim 1, wherein the total area of the two or more heat-absorption peaks is in a range of about 2 J/g to about 9 J/g.

5. The toner of claim 1, wherein the toner has a main peak in a low molecular weight range of about 10,000 g/mol to about 30,000 g/mol and a shoulder in a high molecular weight range of about 100,000 g/mol to about 5,000,000 g/mol in a molecular weight distribution curve obtained by tetrahydrofuran soluble gel permeation chromatography.

6. The toner of claim 1, wherein, in results of tetrahydrofuran soluble gel permeation chromatography analysis of the toner, an amount of molecules having a molecular weight greater than about 5,000,000 g/mol is in a range of about 0.1 wt % to about 1 wt % based on a total weight of a tetrahydrofuran soluble fraction of the toner; an amount of molecules having a molecular weight in a range of about 1,000,000 g/mol to about 5,000,000 g/mol is in a range of about 0.5 wt % to about 3 wt % based on the total weight of the tetrahydrofuran soluble fraction of the toner; an amount of molecules having a molecular weight in a range of about 100,000 g/mol to about 500,000 g/mol is in a range of about 3 wt % to about 10 wt % based on the total weight of the tetrahydrofuran soluble fraction of the toner; and an amount of molecules having a molecular weight of about 20,000 g/mol or less is in a range of about 45 wt % to about 70 wt % based on the total weight of the tetrahydrofuran soluble fraction of the toner.

7. The toner of claim 1, wherein, in molecular weight measurement by using a gel permeation chromatography method on a tetrahydrofuran soluble fraction, the toner has a weight-average molecular weight of about 30,000 g/mol to about 500,000 g/mol and a Z-average molecular weight of about 1,000,000 g/mol to about 50,000,000 g/mol.

8. The toner of claim 1, wherein a weight loss ratio of the wax measured by thermogravimetric analysis at 220° C. for 1 hour is in a range of about 0.5% to about 30%.

9. The toner of claim 1, wherein the toner comprises the wax in an amount of about 1 wt % to about 8 wt % based on a total weight (100 wt %) of the toner.

10. The toner of claim 1, wherein a weight loss ratio of the toner measured by thermogravimetric analysis at 220° C. for 1 hour is in a range of about 0.5% to about 3%.

11. The toner of claim 1, wherein a temperature at which a shear storage modulus of the toner begins to decrease in a shear storage modulus curve of the toner according to temperature changes is in a range of about 54° C. to about 67° C.

12. The toner of claim 1, further comprising an external additive.

13. The toner of claim 12, wherein the external additive is selected from the group consisting of about 1,000 ppm to about 10,000 ppm of iron and about 1,000 ppm to about 5,000 ppm of silicon.

14. The toner of claim 1, further comprising a shell layer, wherein the core particles are coated with the shell layer.

15. The toner according to claim 14, wherein the shell layer includes a binder resin.

16. The toner of claim 1, wherein the wax has a melting point in a range of about 50° C. to about 150° C.

17. The toner of claim 1, wherein an amount of the wax is in a range of about 1 part by weight to about 20 parts by weight based on 100 parts by weight of the binder resin.

18. The toner of claim 12, wherein the external additive is selected from the group consisting of silica particles and titanium particles.

* * * * *